US008159410B2

(12) United States Patent
Oliver et al.

(10) Patent No.: US 8,159,410 B2
(45) Date of Patent: Apr. 17, 2012

(54) REFLECTIVE ANTENNA ASSEMBLY

(75) Inventors: Leslie E. Oliver, Thousand Oaks, CA (US); Daniel G. Gonzalez, Topanga, CA (US)

(73) Assignee: Communications & Power Industries, Inc., Palo Alto, CA (US)

( * ) Notice: Subject to any disclaimer, the term of this patent is extended or adjusted under 35 U.S.C. 154(b) by 196 days.

(21) Appl. No.: 11/933,053

(22) Filed: Oct. 31, 2007

(65) Prior Publication Data

US 2009/0109108 A1 Apr. 30, 2009

(51) Int. Cl.
*H01Q 13/00* (2006.01)

(52) U.S. Cl. ..... 343/882; 343/781 CA; 343/778; 343/872

(58) Field of Classification Search ..... 343/781 P, 343/781 CA, 757, 765, 766, 772, 775, 778, 343/872, 882, 915
See application file for complete search history.

(56) References Cited

U.S. PATENT DOCUMENTS 3,911,441 A * 10/1975 Stein ..... 343/709
4,905,014 A * 2/1990 Gonzalez et al. ..... 343/909
5,594,460 A * 1/1997 Eguchi ..... 343/765
6,031,502 A * 2/2000 Ramanujam et al. ..... 343/761
6,366,255 B1 * 4/2002 Chiang ..... 343/781 P
2005/0280593 A1 * 12/2005 Cha et al. ..... 343/757
2008/0084357 A1 * 4/2008 Smeltzer ..... 343/757

* cited by examiner

*Primary Examiner* — Dieu H Duong
(74) *Attorney, Agent, or Firm* — Hoffmann & Baron, LLP

(57) ABSTRACT

A reflective antenna is provided according to one or more embodiments of the invention. In one embodiment, the reflective antenna may include a radome having a fixed orientation within the elevation plane. According to another embodiment, a reflective antenna positioned within the radome. The reflective antenna may include a feedhorn configured to provide electromagnetic energy at an operation frequency. In another embodiment, the reflective antenna may include a reflective surface having multiple electromagnetically loading structures. The reflective surface may be curved in the azimuth plane and configured to reflect the electromagnetic energy relative to at least one focal point. According to another embodiment, the reflective antenna may include a support structure configured to position the feedhorn and reflective surface within the radome in order to angularly steer the electromagnetic energy with respect to the elevation plane.

23 Claims, 3 Drawing Sheets

REFLECTIVE ANTENNA ASSEMBLY

FIELD OF THE INVENTION

The present invention relates in general to reflective antennas, and more particularly to a reflective antenna assembly including a reflective antenna configured to provide beam scanning in the elevation plane.

BACKGROUND

Conventional reflective antennas have been used for many applications including communications, radar, scanning, tracking, etc. Typical reflective antennas employ parabolic reflectors to focus electromagnetic energy to a particular focal point. Conventionally, reflective antenna structures are limited by restrictions imposed by parabolic reflectors. For example, parabolic reflectors are severely limited for use in high wind applications as parabolic reflectors exhibit high resistance to air flow. Conventional structures have suggested the use of enclosures for such reflective antennas. However, the parabolic curvature for such structures requires a deep curve in the reflector, limiting mobility the parabolic reflector within such structures.

Further, it has been suggested to electromagnetically emulate curved reflective surfaces of any geometry using a substantially planar microwave reflector antenna configuration. U.S. Pat. No. 4,905,014 issued to Gonzalez et al., Feb. 27, 1990, the contents of which are fully incorporated herein by reference, teaches a phasing structure emulating desired reflective surfaces regardless of the geometry of the physical surfaces to which the microwave phasing structure is made to conform, wherein the structure may be fabricated as a fraction of the wavelength of the operating frequency of the phasing surface. The aforementioned technology, marketed as Flat Parabolic Surface (FLAPS™) technology accomplishes the aforementioned function using a dipole antenna placed in front of a ground plane. However, such planar structures require large reflective surfaces at operating frequencies and may be susceptible to scan degradation.

While conventional antenna structures teach phasing structures of multiple geometries and different surfaces, such structures struggle to provide multiple high gain beams.

BRIEF SUMMARY OF THE INVENTION

Disclosed and claimed herein is a reflective antenna assembly according to one or more embodiments of the invention. In one embodiment, the reflective antenna assembly includes a radome having a fixed orientation within the elevation plane and a reflective antenna positioned within the radome. The reflective antenna includes a feedhorn configured to provide electromagnetic energy at an operation frequency and a reflective surface having a plurality of electromagnetically loading structures. The reflective surface may be curved in the azimuth plane and configured to reflect the electromagnetic energy relative to at least one focal point. The reflective antenna further includes a support structure configured to position the feedhorn and the reflective surface within the radome in order to angularly steer the electromagnetic energy with respect to the elevation plane.

Other aspects, features, and techniques of the invention will be apparent to one skilled in the relevant art in view of the following detailed description of the invention.

DETAILED DESCRIPTION OF EXEMPLARY EMBODIMENTS

Figure 1:
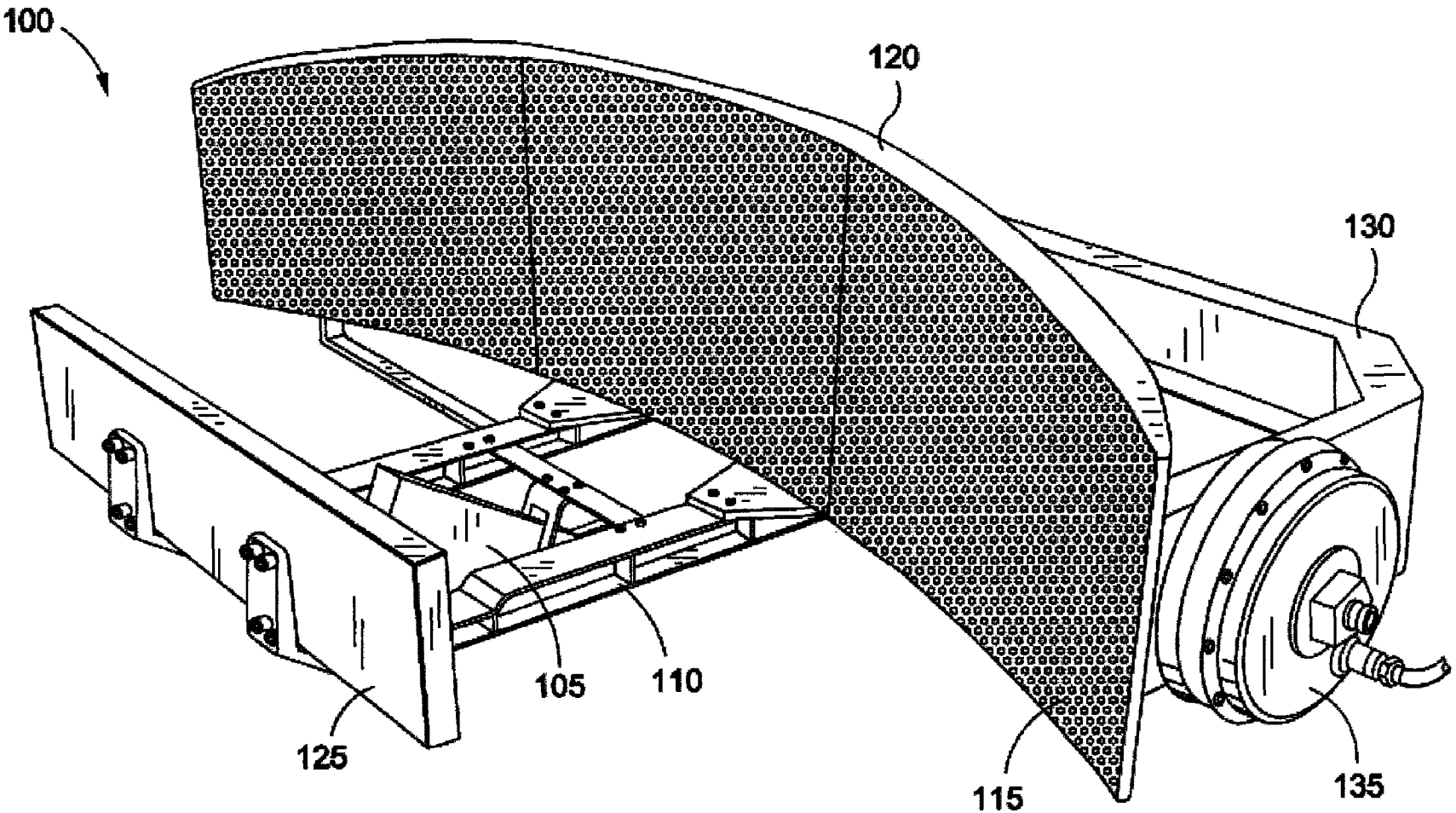
FIG. 1 depicts one or more embodiments of a reflective antenna as may be employed by a reflective antenna assembly according to one embodiment of the invention.

One aspect of the invention is to provide a reflective antenna assembly having a reflective antenna positioned within a radome. In one embodiment, the reflective antenna may include a reflective surface, a feedhorn arrangement and a support structure. The reflective surface may include a plurality of electromagnetic loading structures and a ground plane. According to another embodiment, the reflective surface geometry may be characterized as curved in the azimuth plane. Further, the reflective surface may be configured to reflect the electromagnetic energy relative to at least one focal point. For example, the reflective surface may reflect electromagnetic energy associated with a feedhorn. Similarly, it may be appreciated that electromagnetic energy incident on the reflective surface may be reflected to a focal point. In certain embodiments, the curved reflective surface may be characterized as having a non-parabolic geometry.

According to another embodiment, the reflective antenna feedhorn may include a single feedhorn and/or a feedhorn array. The feedhorn may be configured to provide electromagnetic energy at an operation frequency. In another embodiment, the support structure may be configured to position the feedhorn and the reflective surface within the radome in order to angularly steer the electromagnetic energy with respect to the elevation plane. In yet another embodiment, the radome may be arranged in a fixed orientation with respect to the elevation plane.

According to another embodiment, a reflective antenna assembly may be provided including a sub-reflector having a plurality of electromagnetically loading structures configured to reflect the electromagnetic energy. The support structure may be configured to position the feedhorn, sub-reflector and reflective surface within a radome in order to angularly steer the electromagnetic energy with respect to the elevation plane. In that fashion, the feedhorn, reflective surface and sub-reflector may be arranged in a cassegrain configuration.

In one embodiment, the reflective antenna may include a mechanical actuator configured to position the reflective antenna in the elevation plane. The mechanical actuator may be integrated with the support structure. According to another embodiment, the geometry of the reflective surface may allow for angular positioning in the elevation plane within the radome. As such, the reflective antenna may be positioned a predefined degree in relation to a reference angle. To that end, the reflective antenna may be employed for scanning, tracking and telemetry applications. For example, a reflective antenna may be provided for telemetering data between a manned airborne vehicle and one at least one of a Unmanned Aerial Vehicle (UAV) and a terrestrial communications system.

As used herein, the terms "a" or "an" mean one or more than one. The term "plurality" mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means any of the following: A; B; C; A and B; A and C; B and C; A, B and C. An exception to this definition will occur only when a combination of elements, functions, steps or acts are in some way inherently mutually exclusive.

Reference throughout this document to "one embodiment", "certain embodiments", "an embodiment" or similar term means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner on one or more embodiments without limitation.

Referring now to FIG. 1, depicted is one embodiment of an reflective antenna 100 configured in accordance with the principles of the invention. As shown, reflective antenna 100 includes a feedhorn 105, a reflective surface 115 and support structure 110. In one embodiment, feedhorn 105 comprises a single feedhorn and/or a feedhorn array. Feedhorn 105 may be configured to transmit, or receive, electromagnetic energy to, or from, reflective surface 115. Further, feedhorn 105 may be coupled to a back-end system (not shown) for processing electromagnetic energy received. In one embodiment, the back-end system may provide processing circuitry or circuitry in general for reflective antenna 100. Similarly, feedhorn 105 may be configured to transmit electromagnetic energy received from the back end system. According to another embodiment, feedhorn 105 may be configured for an operational range of 1-100 GHz. However, it may be appreciated that reflective antenna may configured to employ other frequency values.

According to another embodiment of the invention, the reflective surface 115 of reflective antenna 100 may include an arrangement of electromagnetic loading structures. In one embodiment, the arrangement of electromagnetically-loading structures may be disposed on the reflective surface 115 to emulate a desired reflective geometry. Such electromagnetically-loading structures may vary in dimension, having an orientation and interspacing from each other. In certain embodiments, such electromagnetically-loading structures may correspond to the electromagnetically-loading structures disclosed in the previously-incorporated U.S. Pat. No. 4,905,014, the details of which are fully disclosed therein. By way of example, the arrangement of electromagnetically-loading structures may comprise an array of metallic patterns, where each metallic pattern having a cross (i.e., X) configuration with dimensions, orientation, and interspacing such that the desired reflective surface of selected geometry is obtained. Each metallic pattern may constitute a shorted crossed dipole. In that fashion, reflective surface 115 may conform to a plurality of geometries including at least one of a planar surface, curved surface and any other surface geometry in general. As shown in FIG. 1, reflective surface 115 is depicted as curved in the azimuth plane in accordance with one or more embodiments of the invention. Further, reflective surface 115 may be characterized as having a low depth curve, wherein a low depth curve may exhibit less depth than a parabolic curve. However, it may be appreciated that other reflective surface geometries may be employed by reflective surface 115.

According to another embodiment, reflective surface 115 may be an electrically thin surface. For example, an electrically thin phasing surface may provide electromagnetically emulating of a desired reflective surfaces regardless of the geometry of the physical surfaces to which the electrically thin microwave phasing structure is made to conform. As used hereinafter, the term "electrically thin" shall mean on the order of a fraction of the wavelength of the operating frequency of the microwave phasing structure.

In certain embodiments, reflective antenna 100 may include a sub-reflector 125. Similar to reflective surface 115, sub-reflector 125 may include an arrangement of electromagnetic loading structures. As such, sub-reflector 125 may be configured to reflect electromagnetic energy relative to at least one of reflective surface 115 and feed horn 105. As shown in FIG. 1, sub-reflector 125 is depicted as having a planar geometry in accordance with one or more embodiments of the invention. However, it may be appreciated that other geometries may be employed by sub-reflector 125. According to another embodiment, sub-reflector 125 may be positioned such that it minimizes blockage of incident electromagnetic energy to reflective surface 115. To that end, sub-reflector 125 may be arranged offset from reflective surface 115.

According to another embodiment, reflective surface 115 may be configured to reflect incident electromagnetic energy relative to one of feedhorn 105 and sub-reflector 125. Similarly, it may be appreciated that electromagnetic energy incident on reflective surface 115 may be reflected to one of feedhorn 105 and sub-reflector 125. In yet another embodiment, reflective surface 115 may include a ground plane. The ground plane may be place a distance from electromagnetic loading structures supported by reflective surface 110. Similarly, sub-reflector 125 may be configured to reflect incident electromagnetic energy relative to one of feedhorn 105 and reflective surface 115. Additionally, sub-reflector 125 may include a ground plane.

Continuing to refer to FIG. 1, support structure 110 may be configured to support feedhorn 105, reflective surface 115 and sub-reflector 125 according to one or more embodiments of the invention. In one embodiment, support structure 110 may be manufactured of aluminum. However, it may be appreciated that other materials may be employed for support structure 110. Additionally, mechanical actuator 135 may be integrated with support structure 110. Mechanical actuator 135 may be configured to position antenna assembly 100 such that electromagnetic energy may be directed in a particular direction in the elevation plane as will be described below in more detail with reference to FIGS. 2A-2C. In one embodiment, mechanical actuator may be one of a electric drive, hydraulic drive and mechanical drive means in general configured to position reflective antenna within a predetermined angle of motion. According to another embodiment, support structure 110 may be configured to arrange feedhorn 105, reflective surface 115 and sub-reflector 125 in a cassegrain configuration.

According to another embodiment, support structure 110 may include sub-structure 120 configured to support reflective surface 115. According to another embodiment, support structure 110 may include base 130 configured to arrange reflective antenna 100. Base 130 may be coupled to support structure 110 by mechanical actuator 135 such that feedhorn arrangement 105 may be adjusted angularly and/or repositioned as discussed in more detail below with respect to FIG. 2A-C. In that fashion, reflective antenna 100 may be configured to transmit and receive electromagnetic energy from various angles in the elevation plane.

Figure 2A:
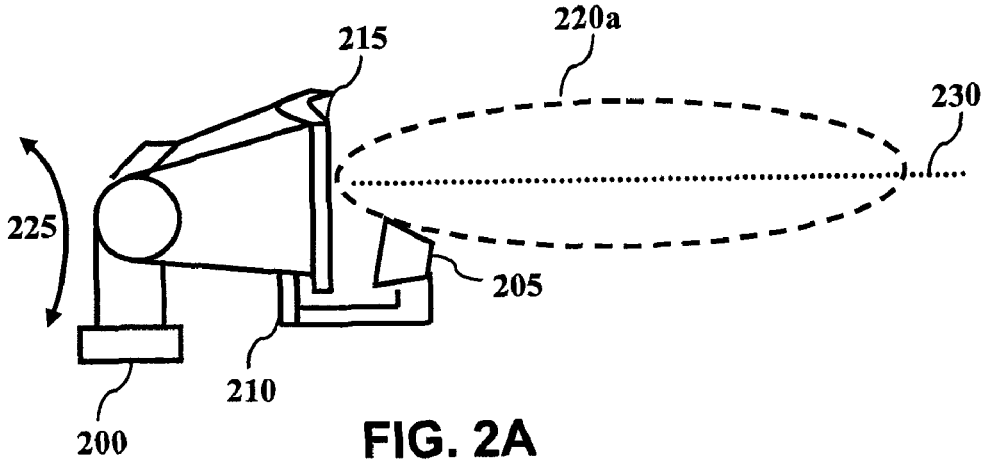
FIGS. 2A-2C depict a simplified antenna arrangement according to one embodiment of the reflective antenna of FIG. 1.
Figure 2B:
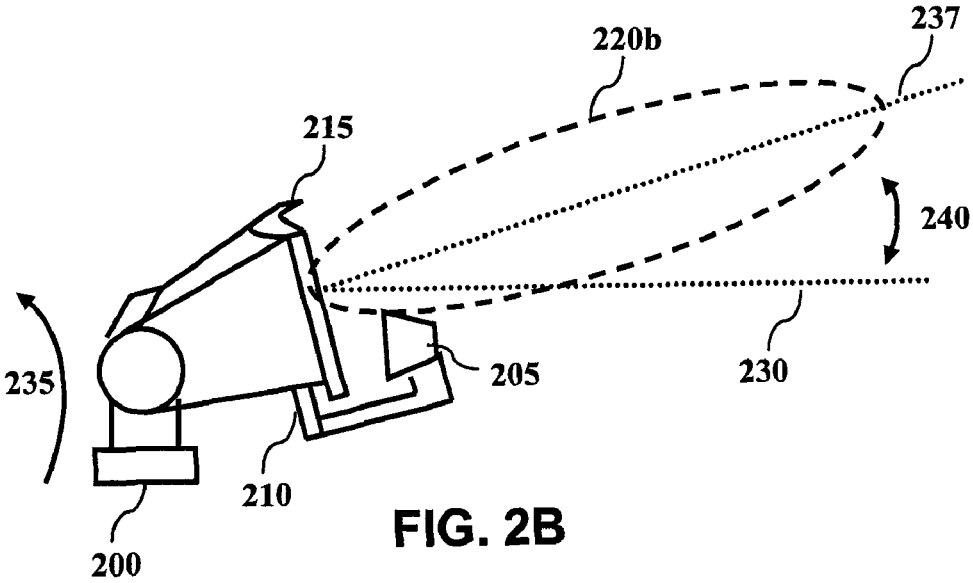
Figure 2C:
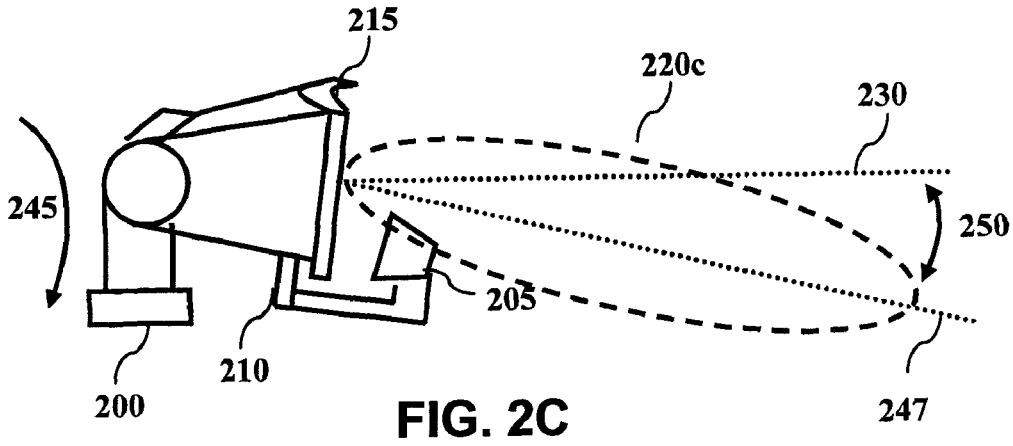

Referring now to FIGS. 2A-2C, one embodiment of a simplified antenna arrangement is shown of reflective antenna 200 which may correspond to reflective antenna 100 of FIG. 1. Referring now to FIG. 2A, reflective antenna 200 includes feedhorn 205, reflective surface 215 and support structure 210. In one embodiment, reflective antenna 200 may include a sub-reflector (e.g., sub-reflector 125). As such, reflective antenna 200 may be arranged in a cassegrain configuration.

According to another embodiment, reflective antenna 200 may be configured to produce a beam of electromagnetic energy characterized by scan pattern 220*a*. As shown in FIG. 2A, scan pattern 220*a* is characterized as having a single lobe. It may be appreciated that reflective antenna 200 may be configured to produce electromagnetic energy having a plurality of scan patterns. For example, reflective antenna 200 may be configured to generate one of a pencil beam and a shaped beam, such as cosecant-squared beam shape. It may be appreciated that scan pattern 220*a* may correspond to a direction reflective surface 215 is facing. In one embodiment, scan pattern 220*a* produced by reflective antenna 200 may be characterized as a narrow beam in at least one the azimuth and elevation planes. According to another embodiment, scan pattern 220*a* may be characterized as exhibiting a wide beamwidth in the elevation plane. Wide beamwidth in the elevation plane may be suitable for mapping purposes.

As shown in FIG. 2A, reflective antenna 200 is positioned facing a direction as indicated by 230. In certain embodiments, direction 230 may indicate a reference direction for reflective antenna 200. For example, reflective antenna 200 may be set such that an associated reflective structure is arranged facing direction 230. However, it may be appreciated that reflective antenna 200 may be directed in any other direction as a set position. In one embodiment, reflective antenna 200 may be angularly positioned by a mechanical actuator (e.g., mechanical actuator 135) indicated by 225. According to yet another embodiment, reflective antenna 200 may be configured to generate electromagnetic energy angularly displaced from direction 230 in the elevation plane when reflective antenna 200 is facing direction 230. For example, reflective antenna 200 may be arranged facing direction 230 such that scan pattern 220*a* may be directed +14 degrees in the elevation plane. In that fashion, reflective antenna 200 may be rotated to −34 degrees to +46 degrees resulting in −20 to +60 degree scan radius. In one embodiment, angularly displacing scan pattern 220*a* from direction 230 may be employed to optimize scanning radius within a sealed enclosure.

As shown in FIG. 2B, reflective antenna 200 is positioned such that mechanical actuator rotates antenna assembly 200 in the direction as indicated by 235. Accordingly, scan pattern 220*b* is shown as may be produced by reflective assembly 200 when positioned in the direction as indicated by 237. As such, reflective antenna 200 may angularly steer electromagnetic energy with respect to the elevation plane a number of degrees, as indicated by 240, in relation to the reference direction as indicated by 230.

Referring now to FIG. 2C, reflective antenna 200 is positioned such that mechanical actuator rotates in the direction as indicated by 245. Accordingly, scan pattern 220*c* is shown as may be produced by reflective assembly 200 when positioned in the direction as indicated by 247. As such, reflective antenna 200 may angularly steer electromagnetic energy with respect to the elevation plane a number of degrees, as indicated by 250, in relation to the reference direction as indicated by 230. In that fashion, reflective antenna 200 may provide beam steering in the elevation plane. In one embodiment, reflective antenna 200 may be configured to provide beam steering over a range of 206 degrees. However, it may be appreciated that reflective antenna 200 may be positioned to provide beam steering over a wider or narrower range.

Figure 3A:
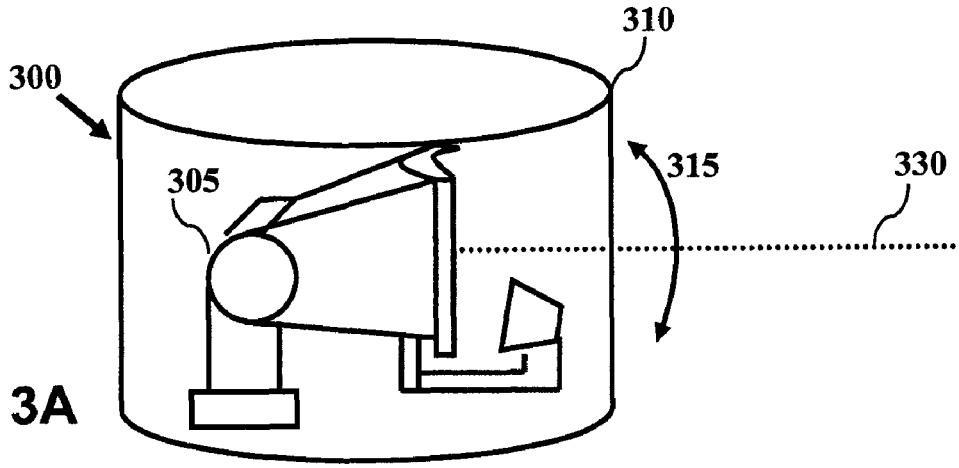
FIGS. 3A-3C depict a simplified antenna assembly arrangement according to one embodiment of the invention.
Figure 3B:
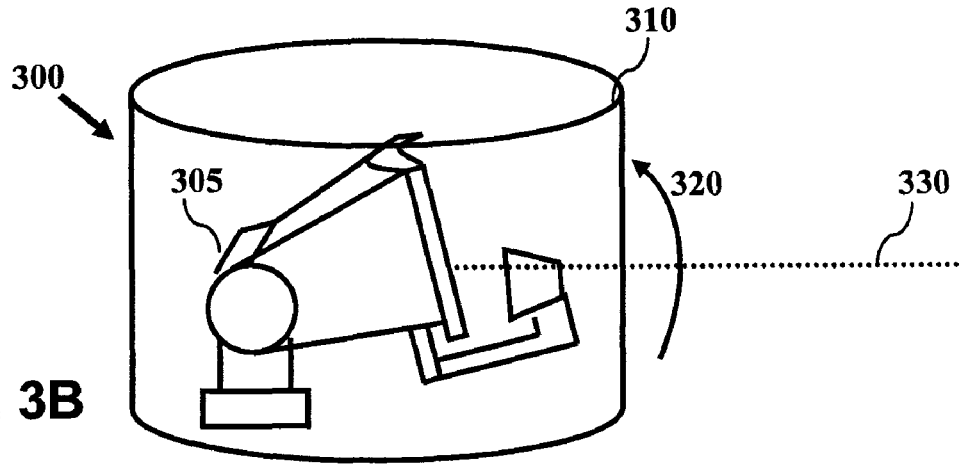
Figure 3C:
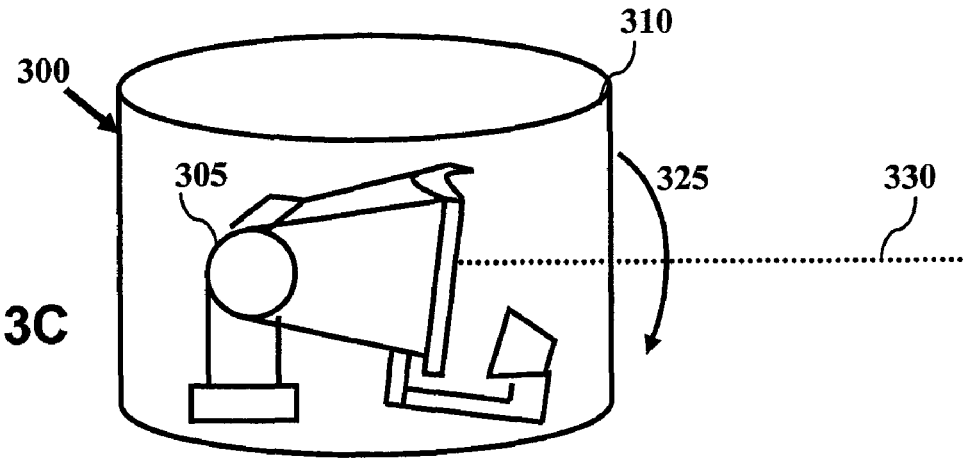

Referring now to FIGS. 3A-3C, a simplified block diagram is provided of an antenna assembly 300 according to one of more aspects of the invention. As shown in FIGS. 3A-3C, antenna assembly 300 includes reflective antenna 305 (e.g., corresponding to reflective antenna 100) and radome 310. According to one embodiment of the invention, reflective antenna 305 may be angularly positioned, with respect to the elevation plane, within radome 310. As shown in FIG. 3A, reflective antenna 305 is positioned facing direction 330 (e.g., corresponding to direction 230). In certain embodiments, direction 330 may indicate a reference position for reflective antenna 305. However, it may be appreciated that reflective antenna 305 may be directed in any other direction as a set position. In one embodiment, reflective antenna 305 may be positioned by a mechanical actuator (e.g., mechanical actuator 135) along the path indicated by 315. Accordingly, reflective antenna 305 may be configured to produce a electromagnetic energy in the direction of as indicated by 330. As shown in FIG. 3B, reflective antenna 305 is positioned a number of degrees, in the direction as indicated by 320, in relation to reference direction 330.

Referring now to FIG. 3C, reflective antenna 305 is positioned a number of degrees, in the direction as indicated by 325, in relation to reference direction 330. As such, reflective antenna 305 may be angularly positioned within radome 310 to angularly steer electromagnetic energy with respect to the elevation plane. In that fashion, reflective antenna 305 may provide beam steering in the elevation plane within radome 310. In one embodiment, antenna assembly 300 may be configured to provide beam steering using reflective antenna 305 within radome 310 in the range of 90 degrees. However, it may be appreciated that reflective antenna 305 may be positioned to provide other values of range in degrees. According to another embodiment, reflective antenna 305 may be rotated about an axis such that a 360° scan may be generated in the azimuth plane.

According to another embodiment of the invention, radome 310 may be manufactured of an electrically transmissive material. In one embodiment, radome 310 may be configured to be electrically transmissive to operation frequencies of a reflective antenna (e.g., reflective antenna 100). As such, radome 310 may be constructed of one of fiberglass, Kevlarm and Spectracloth™. According to another embodiment, radome 310 may be a sealed enclosure configured to provide a protective enclosure for reflective antenna 305.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. Trademarks and copyrights referred to herein are the property of their respective owners.

What is claimed is:

1. A reflective antenna assembly comprising:

a radome having a fixed orientation within the elevation plane; and a reflective antenna positioned within the radome, the reflective antenna including:

a feedhorn configured to provide electromagnetic energy at an operation frequency;

a reflective surface having a plurality of electromagnetically loading structures, the reflective surface curved in the azimuth plane and configured to reflect the electromagnetic energy relative to at least one focal point, the reflective surface being configured to generate electromagnetic energy that is angularly displaced in the elevation plane from that direction in which the reflective surface is facing;

a support structure configured to rotate said feedhorn and said reflective surface within the radome in order to angularly steer the electromagnetic energy with respect to the elevation plane; and a sub-reflector having a plurality of electromagnetically loading structures.

2. The reflective antenna assembly of claim 1, wherein the feedhorn arrangement comprises a feedhorn array.

3. The reflective antenna assembly of claim 1, wherein the support structure is configured to arrange the sub-reflector such that the feedhorn, reflective surface and sub-reflector are arranged in a cassegrain configuration.

4. The reflective antenna assembly of claim 3, wherein the sub-reflector is arranged off-set in relation to the reflective surface by the support structure.

5. The reflective antenna assembly of claim 1, further comprising a mechanical actuator coupled to the support structure, the mechanical actuator configured to position the reflective antenna in the elevation plane.

6. The reflective antenna assembly of claim 1, wherein the reflective surface geometry allows angular positioning in the elevation plane within the radome a predefined degree in relation to a reference angle.

7. The reflective antenna assembly of claim 1, wherein the radome is electrically transmissive to electromagnetic energy with the operation frequency.

8. The reflective antenna assembly of claim 7, wherein said support structure is configured to position the curved reflective surface in the elevation plane within the radome.

9. The reflective antenna assembly of claim 1, wherein the reflective surface is curved in only the azimuth plane.

10. The reflective antenna assembly of claim 1, wherein the reflective surface comprises a non-parabolic geometry.

11. The reflective antenna assembly of claim 1, wherein the reflective surface comprises a low depth curve having less depth than a parabolic curve.

12. A reflective antenna assembly comprising:

a radome having a fixed orientation within the elevation plane; and a reflective antenna positioned within the radome, the reflective antenna including:

a feedhorn configured to provide electromagnetic energy at an operation frequency;

a reflective surface having a plurality of electromagnetically loading structures, the reflective surface curved in the azimuth plane and configured to reflect the electromagnetic energy, the reflective surface being configured to generate electromagnetic energy that is angularly displaced in the elevation plane from that direction in which the reflective surface is facing;

a sub-reflector having a plurality of electromagnetically loading structures configured to reflect the electromagnetic energy; and a support structure configured to rotate said feedhorn, said sub-reflector and said reflective surface within the radome in order to angularly steer the electromagnetic energy with respect to the elevation plane.

13. The reflective antenna assembly of claim 12, wherein the feedhorn arrangement comprises a feedhorn array.

14. The reflective antenna assembly of claim 12, wherein the sub-reflector comprises one of a planer and curved surface in the azimuth plane.

15. The reflective antenna assembly of claim 14, wherein the support structure is configured to arrange the sub-reflector such that the feedhorn, reflective surface and sub-reflector are arranged in a cassegrain configuration.

16. The reflective antenna assembly of claim 15, wherein the sub-reflector is arranged off-set in relation to the reflective surface by the support structure.

17. The reflective antenna assembly of claim 12, further comprising a mechanical actuator coupled to the support structure, the mechanical actuator configured to position the reflective antenna in the elevation plane.

18. The reflective antenna assembly of claim 12, wherein the reflective surface geometry allows angular positioning in the elevation plane within the radome a predefined degree in relation to a reference angle.

19. The reflective antenna assembly of claim 12, wherein the radome is electrically transmissive to electromagnetic energy with the operation frequency.

20. The reflective antenna assembly of claim 19, wherein said support structure is configured to position the curved reflective surface in the elevation plane within the radome.

21. The reflective antenna assembly of claim 12, wherein the reflective surface is curved in only the azimuth plane.

22. The reflective antenna assembly of claim 12, wherein the reflective surface comprises a non-parabolic geometry.

23. The reflective antenna assembly of claim 12, wherein the reflective surface comprises a low depth curve having less depth than a parabolic curve.

* * * * *